US005957660A

United States Patent [19]

Evans et al.

[11] Patent Number: 5,957,660

[45] Date of Patent: Sep. 28, 1999

[54] TURBINE ROTOR DISK

[75] Inventors: Neil M Evans, Bristol, United Kingdom; Thomas Schillinger, Berlin, Germany

[73] Assignee: BMW Rolls-Royce GmbH, Oberursel, Germany

[21] Appl. No.: 09/020,127

[22] Filed: Feb. 6, 1998

[30] Foreign Application Priority Data

Feb. 13, 1997 [DE] Germany ..... 197 05 441

[51] Int. Cl.[6] ..... B63H 1/14

[52] U.S. Cl. ..... 416/97 R; 416/95; 416/96 R; 416/248; 416/193 A; 415/115

[58] Field of Search ..... 416/97 R, 95, 416/96 R, 220 R, 193 A, 248; 415/115

[56] References Cited

U.S. PATENT DOCUMENTS

| | | | |
|---|---|---|---|
| 2,447,292 | 8/1948 | Van Acker . | |
| 2,931,624 | 4/1960 | Hyde . | |
| 4,047,837 | 9/1977 | Hueber . | |
| 4,178,129 | 12/1979 | Jenkinson . | |
| 4,522,562 | 6/1985 | Glowacki . | |
| 5,201,849 | 4/1993 | Chambers et al. | 416/95 |
| 5,339,619 | 8/1994 | Antonellis | 60/39.02 |

FOREIGN PATENT DOCUMENTS

| | | |
|---|---|---|
| 0353447 | 2/1990 | European Pat. Off. . |
| 2381179 | 9/1978 | France . |
| 573481 | 4/1933 | Germany . |
| 2357326 | 5/1975 | Germany . |
| 2947521 | 6/1986 | Germany . |
| 765225 | 1/1957 | United Kingdom . |
| 801689 | 9/1958 | United Kingdom . |
| 2057573 | 4/1981 | United Kingdom . |

*Primary Examiner*—F. Daniel Lopez
*Assistant Examiner*—Ninh Nguyen
*Attorney, Agent, or Firm*—Pillsbury Madison & Sutro LLP

[57] ABSTRACT

In connection with a turbine rotating disk with disk grooves, constituted by disk fingers, for receiving turbine blades, as well as with measures for guiding a cooling air flow from a chamber located in front of the disk to one behind the disk, a cooling air transfer channel is provided in at least some of the disk fingers, which respectively starts at the front disk face, and makes a transition into a cooling air exhaust channel, also essentially extending in the radial direction in the disk finger, whose outlet opening on the rear disk face side lies closer to the disk axis than the disk ring section, which has the disk grooves and is widened in the disk axial directions. By means of this it is possible to convey a larger cooling air flow which, in an advantageous manner, indirectly aids the cooling of the disk in the area of the disk grooves.

8 Claims, 2 Drawing Sheets

TURBINE ROTOR DISK

FIELD OF THE INVENTION

The invention relates to a turbine impeller disk with disk grooves, constituted by disk fingers, for receiving turbine blades, as well as with measures for guiding a cooling air flow from a chamber located in front of the disk to one behind the disk.

BACKGROUND OF THE INVENTION

In connection with the technical background, reference is made, besides German Patent Publication DE 29 47 521 A1, in particular to German Patent Publication DE 34 44 586 A1.

In connection with the employment of air-cooled turbine blades, in particular in gas turbines, the cooling air supply for these turbine blades via channels in the turbine rotating disks which terminate in the disk grooves, has basically proven itself. In this manner it is also possible to supply cooling air to a second turbine rotating disk arranged behind a first rotating disk, in that a portion of the air flow reaching the disk grooves of the first rotating disk is moved via these disk grooves towards the back, so to speak, into the space between the first and second rotating disk. To this end it is possible to provide appropriate passages in the so-called closure plates, which secure the blades inserted into the disk grooves.

The conveyance of a sufficiently large cooling air flow into the respective disk groove can be problematical, if a portion of this cooling air flow is also intended for cooling a downstream turbine rotating disk. It is not possible to design the cross-sectional surface of a cooling air channel terminating in the groove bottom of the disk groove to have any arbitrary size, since in this outlet area the spatial regions of the individual stress concentrations of the peripheral stress are superimposed on each other and can cause locally greatly increased stress levels which are undesirable.

OBJECT AND SUMMARY OF THE INVENTION

It is the object of the instant invention to disclose remedial steps for the above mentioned problems.

This objective is attained in that a cooling air transfer channel respectively starting at the front disk face side is provided in at least some of the disk fingers, which makes a transition into a cooling air exhaust channel, also essentially extending in a radial direction in the disk fingers, whose outlet opening at the rear disk face side lies closer toward the disk axis than the disk ring section which has the disk grooves and is widened in the disk axial direction.

Advantageous embodiments and further developments are the subject of the dependent claims.

In accordance with the invention, at least one separate cooling air exhaust channel is provided, for example, in the first turbine rotating disk, via which the second turbine rotating disk, for example arranged behind the first rotating disk, is supplied with cooling air. In this case this cooling air blow-off channel in the, for example, first turbine rotating disk extends at least partially in a disk finger of this rotating disk, and in the process is supplied with cooling air by a cooling air transfer channel, which is also at least partially provided in the corresponding disk finger. This cooling air transfer channel here receives the cooling air flow from the chamber in front of the front disk face side, while the cooling air exhaust channel then conveys this cooling air flow into the chamber located in back of the rotating disk. Because in this case the outlet opening of this cooling air blow-out channel lies closer to the disk axis than the disk ring section with the disk grooves, which is customarily widened in the disk axial direction, no mixing of the cooling air flow with the working gas flow conveyed between the turbine blades needs to be feared.

A single cooling air transfer channel and a single cooling air exhaust channel will of course not be sufficient in most cases, so that preferably a plurality of such channels are provided, each respectively with a disk finger. For example, such a channel system can be provided in every second disk finger, or also in every disk finger. Since these cooling air channels are provided for conveying, or respectively guiding a cooling air flow from a chamber located in front of of the turbine rotating disk into a chamber located behind the disk, there is of course no need to fear weakening of the groove bottoms of the disk grooves by this cooling channel system. Instead, in accordance with the invention, the cooling air, for example needed for a second turbine rotating disk, is rerouted, so to speak, around the disk grooves by the described cooling air channels, namely the transfer channel and the exhaust channel.

This as well as further features and advantages also ensue from the following description of two preferred exemplary embodiments, which are represented in sections in the attached drawings.

BRIEF DESCRIPTION OF THE DRAWINGS

FIG. 1 represents a partial longitudinal section through a disk groove of a turbine rotating disk, while

DETAILED DESCRIPTION OF THE PREFERRED EMBODIMENTS

Figure 1:
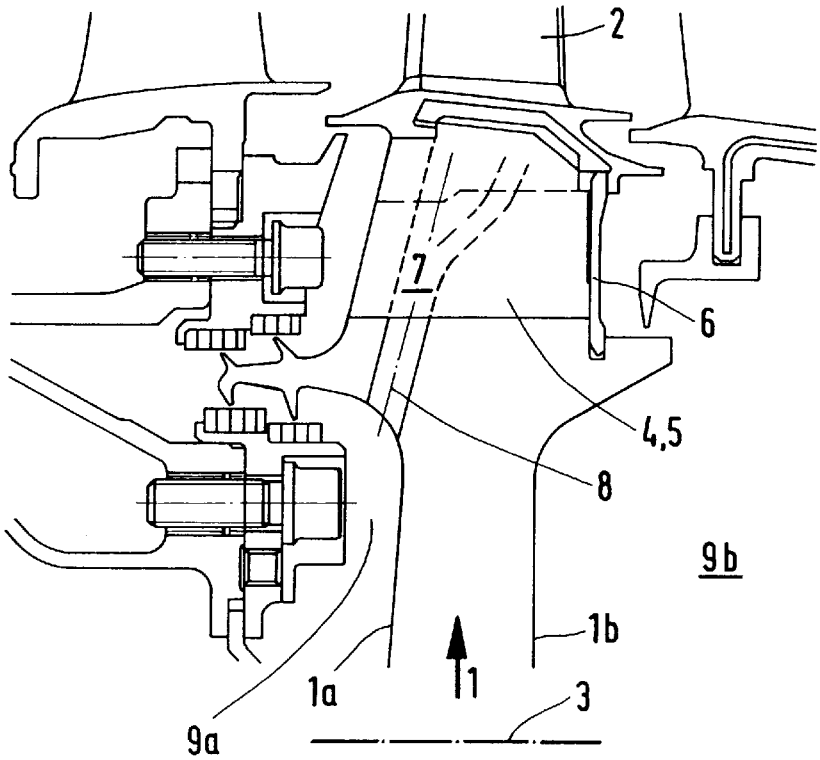

A rotating disk of a gas turbine, which usually supports a plurality of turbine blades 2, is identified by the reference numeral 1. To this end, the rotating disk 1, whose disk axis is identified by the reference numeral 3, has a plurality of disk grooves 4 on the outer circumference, as is customary, for respectively receiving one turbine blade 2, wherein these disk grooves 4 are bordered by so-called disk fingers 5. Furthermore, an also customary closure plate 6 can be recognized in FIGS. 2 and 4, which secures a turbine blade 2 in the respective disk groove 4.

The turbine blades 2 are air-cooled, i.e. a cooling channel system 7 is provided in the interior of each turbine blade 2, which is provided with cooling air through a cooling air channel 8 extending inside the impeller disk 1 from its front face side 1*a* to the groove bottom of the disk groove 4. Therefore a relatively cool air flow—at least in comparison with the working gas conveyed between the turbine blades 2—prevails in the chamber 9*a* which, in front of the disk 1, is clearly located closer to the disk axis 3.

If it is now intended to supply a second turbine rotating disk, not shown, arranged behind the represented rotating disk 1 and therefore located to the right of it, with a cooling air flow, this cooling air flow must be conveyed from the chamber 9*a* into the chamber 9*b*, which is located behind the represented rotating disk 1 and therefore to the right of the rear face side 1*b* of the same. This chamber 9*b* again is located in front of the second not represented, turbine rotating disk located behind the rotating disk 1 represented.

It is basically possible to guide a cooling air flow from the chamber 9*a* via the cooling air channel 8 into the disk groove 4, and from there via suitable passages in the closure plate 6 into the chamber 9*b*. However, since it is necessary to also supply the cooling channel system 7 in each turbine blade 2 with cooling air through this cooling air channel 8, this could result in capacity restrictions, i.e. the cooling air channel 8 would have to have a disproportionally large cross section. Therefore, in accordance with the invention, a cooling air exhaust channel 10 is provided for conducting a cooling air flow from the chamber 9*a* into the chamber 9*b*, which terminates in the latter and is supplied with a cooling air flow by a cooling air transfer channel 11, which is connected with the chamber 9*a*. Both the a cooling air transfer channel 11 and the cooling air exhaust channel 10 extend at least partially within a desk finger 5. Thus, these cooling air channels 10 and 11 do not terminate in the disk groove 4, but are being routed past the disk groove 4 in the disk fingers 5. Therefore no weakening of the groove bottom of the disk groove 4 can be caused by these cooling air channels 10 and 11.

Figure 2:
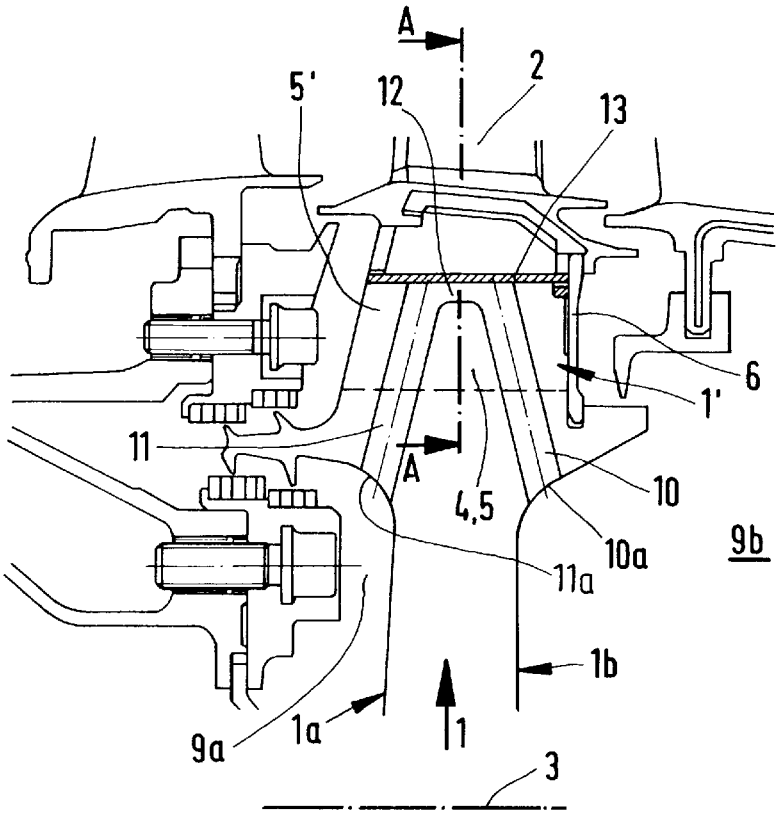
FIG. 2 represents a comparable partial longitudinal section through a disk finger.
Figure 3:
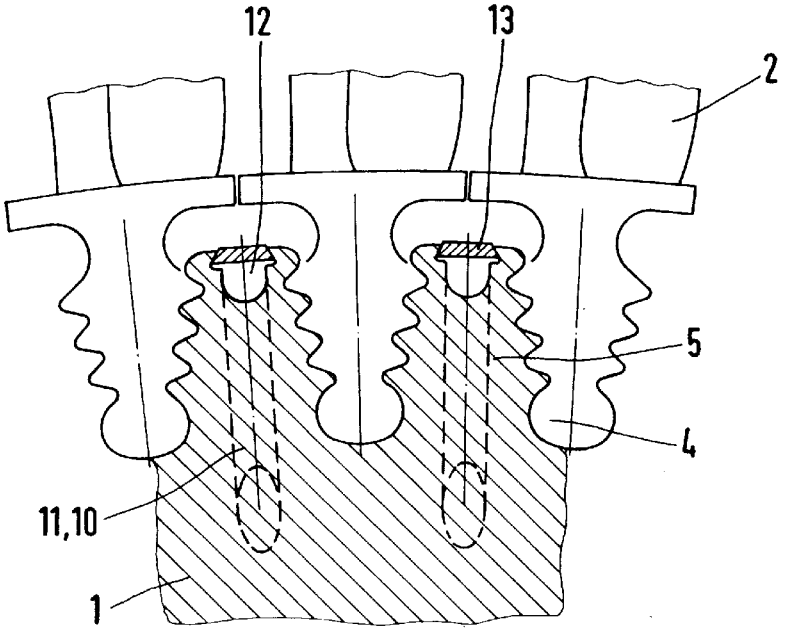
FIG. 3 shows the section A—A in FIG. 2.
Figure 4:
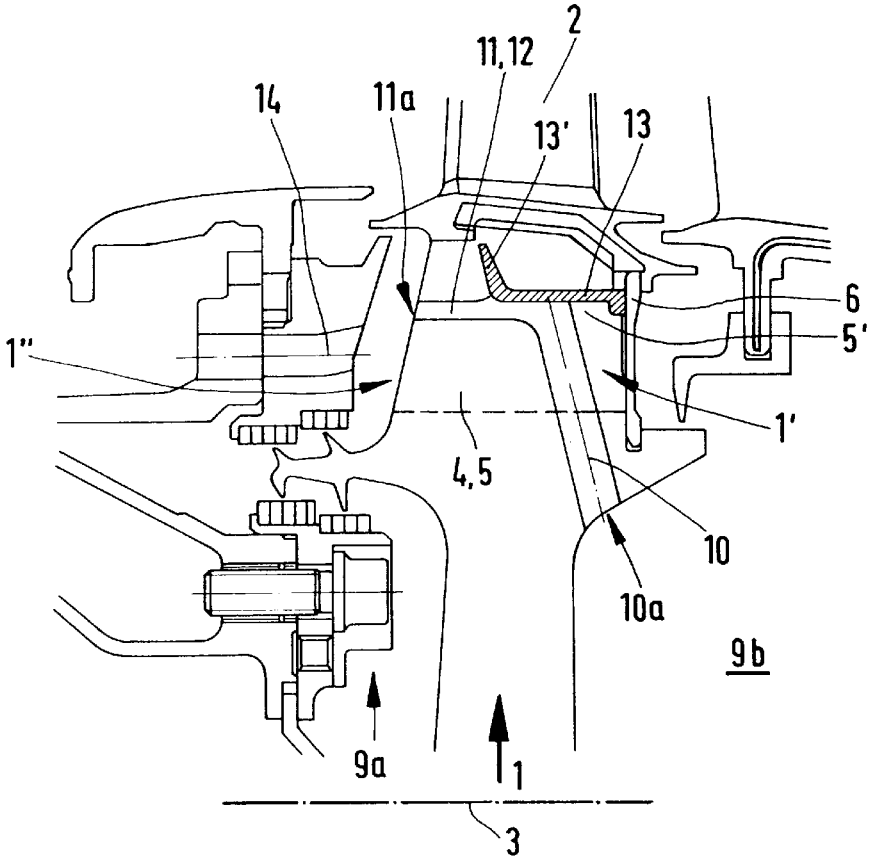
FIG. 4 shows another exemplary embodiment in a representation in accordance with FIG. 2.

In both exemplary embodiments, i.e. in FIG. 2 and FIG. 4, the cooling air exhaust channel 10 extends essentially in a radial direction in the disk finger 5, in this case starts almost in the tip area 5' of the disk finger 5, and its outlet opening 10*a* in the direction toward the chamber 9*b* is located closer to the disk axis 3 than the disk ring section 1' which has the disk grooves 4 and is widened in the direction of the disk axis. It is assured by this that the cooling air flow in the chamber 9*b* does not mix with the working gas flow conveyed between the turbine blades 2.

In the exemplary embodiment in accordance with FIG. 2, the end of the cooling air exhaust channel 10 located opposite the outlet opening 10*a* is connected with a so-called channel groove 12, in which the cooling air transfer channel 11 terminates in turn. In this case the inlet opening 11*a* of the cooling air transfer channel 11 on the front disk face side 1*a* lies at approximately the same level as the outlet opening 10*a* of the exhaust channel 10, i.e. the inlet opening 11*a* is also located in an area of the chamber 9*a* in which a relatively cold air flow is encountered. The cooling air guidance through the described channel system, namely first via a transfer channel 11 in the radial direction toward the exterior, then via the channel groove 12 and Finally the exhaust channel 10 again essentially inward in the radial direction, is particularly advantageous, not only in view of the prevailing pressure conditions, but also for reasons of production techniques. Although it would be possible to let the transfer channel 11 directly terminate in the exhaust channel 10, the angle of inclination of these two channels 10, 11, for one, would be disadvantageous and furthermore, the disk 1 would be weakened in an unfavorable manner by the channels.

This connection of the exhaust channel 10 with the transfer channel 11 via the channel groove 12 is also advantageous to the extent that this channel groove 12 extends in the tip area 5' of the disk finger 5 and therefore can be open toward the outside in the radial direction, i.e. this can be a groove actually machined into the tip area 5' and extending in the direction of the disk axis 3. It is of course necessary to cover the side of the channel groove 12, which is open toward the exterior in the radial direction, in order to achieve the desired cooling air guidance, for which reason a so-called cover plate 13 is provided here. Thus this cover plate 13 borders the channel groove 12 toward, the outside in the radial direction, and in the process can be circumferentially fixed in place between two turbine blades 2, as well as by the closure plate 6 which secures these turbine blades 2.

In the exemplary embodiment in accordance with FIG. 4, the cooling air transfer channel 11 extends essentially parallel with the disk axis 3 in the tip area 5' of the disk finger 5, and in this case is itself embodied as a channel groove 12, whose radially outwardly open side is again covered by a cover plate 13. The design of this channel groove 12 in the exemplary embodiment in accordance with FIG. 4 therefore is similar to that of the exemplary embodiment in accordance with FIG. 2. To assure that a sufficient cooling air flow prevails in the area of the inlet opening 11*a* of this cooling air transfer channel 11 extending essentially parallel with the disk axis 3, annularly arranged pre-swirl nozzles 14, of which of course only one is represented here, are provided for the supply of cooling air in the disk axial direction in front of the disk head area 1", which is approximately located at the level of the disk ring section 1'. So that the cooling air to be introduced into the chamber 9*b* has the lowest possible total temperature in the rotating system, the air in the chamber 9*a* in front of the inlet opening 11*a* is provided with such a strong swirl, or respectively with such a high circumferential speed by the pre-swirl nozzle 14, that the static pressure ratio between the area in front of this inlet opening 11*a* and the working gas flow conveyed between the turbine blades 2 successfully only just prevents the penetration of the working gases into this area in front of the inlet opening 11*a*. In this way it is assured that the relative total inlet temperature stipulated by the thermodynamic process control reaches a minimum. In the course of being transferred into the chamber 9*b*, the conveyed cooling air experiences a reduction of the circumferential speed in accordance with the change of the circumferential radius. Since this is a mostly adiabatic process, the cooling air even yields work to the turbine rotating disk 1 in the course of the said overflow flow process.

Analogously with the exemplary embodiment in accordance with FIG. 2, the cover plate 13 in the exemplary embodiment in accordance with FIG. 4 is also circumferentially fixed in place, among others by the closure plate 6. Furthermore, in its end section facing the inlet opening 11*a*, the cover plate 13 here has a so-called skirt 13', which defines the inlet, or respectively inlet cross section, of the transfer channel 11. Because the defining flow cross section of the cooling air mass flow reaching the chamber 9*b* is therefore formed by a separate and exchangeable element, namely the cover plate 13 with the defining skirt 13', it is possible—at least to a certain extent—to rapidly and cost-effectively vary and optimize the secondary air system of the turbine while retaining the main components, namely the rotating disks 1 in particular.

As already mentioned, a rotating disk 1 in accordance with the invention is distinguished, among others, in that a cooling air flow can be conveyed from the chamber 9*a* in front of the front face side 1*a* into a chamber 9*b* behind the rear front face 1*b*, without the area of the disk grooves 4, and in particular their groove bottom, being weakened by this. Instead, the channel system shown with the traqnsfer channel 11 and exhaust channel 10 extending in one, several or all disk fingers 5 is even advantageous in view of the stress loads on the rotating disk 1 in the area of the disk grooves 4, since the rotating disk 1 is additionally cooled in the area of the disk grooves 4 by the cooling air conducted through the channel system. In this way stress peaks caused by an uneven temperature distribution in the disk 1 are prevented, or respectively reduced. In this connection it is of course possible that a multitude of details, in particular of a structural type, can easily be designed differently from the represented exemplary embodiments, without departing From the contents of the claims. The cross section of the individual cooling air channels 8, 10 and 11, in particular, can be arbitrarily designed, i.e. shaped circularly, elliptically or in any other way corresponding to the respective requirements.

What is claimed is:

1. A turbine rotating disk having disk grooves defined by disk fingers for receiving turbine blades, said disk having means for guiding a cooling air flow from a chamber located on one side of the disk to a chamber located on the opposite side of the disk, wherein some of said disk fingers including a cooling air transfer channel extending from said one side of said disk and passing to a cooling air exhaust channel extending substantially in a radial direction in said disk finger and having an outlet opening on said other side of said disk closer to the disk axis then a disk ring section having said disk grooves, said exhaust channel widening as said exhaust channel approaches said disk axis.

2. The turbine rotating disk in accordance with claim 1, characterized in that the inlet opening (11*a*) of the cooling air transfer channel (11), which extends in the radial direction, terminates on one face of the disk (1*a*) at approximately the same level as the cooling air exhaust channel (10) on the other face of the disk (1*b*).

3. The turbine rotating disk in accordance with claim 2, characterized in that the cooling air transfer channel (11) and the cooling air exhaust channel (10) are connected with each other via a channel groove (12), which extends essentially parallel with the disk axis (3) in the tip area (5') of the disk finger (5) and whose radially outwardly open side is covered with a cover plate (13).

4. The turbine rotating disk in accordance with claim 1, characterized in that in the tip area (5') of the disk finger (5) the cooling air transfer channel (11) extends essentially parallel with the disk axis (3), and at least one swirl nozzle (14) for supplying the cooling air is provided in the disk axis direction in front of the disk head area (1").

5. The turbine rotating disk in accordance with claim 4, characterized in that the cooling air transfer channel (11) is embodied as a channel groove (12), whose radially outwardly open side is covered with a cover plate (13).

6. The turbine rotating disk in accordance with claim 5, characterized in that the cover at plate (13) has a skirt (13'), which determines the inlet of the transfer channel (11).

7. The turbine rotating disk in accordance with claim 1, characterized in that the cover plate (13) is circumferentially secured between the turbine blades (2) by the closure plate (6), which also secures these turbine blades (2).

8. The turbine rotating disk in accordance with claim 1, characterized in that further cooling air channels (8) extending from the front disk face side (1*a*) terminate in the disk grooves (4).

* * * * *